US007125328B1

(12) United States Patent
Hacikyan

(10) Patent No.: US 7,125,328 B1
(45) Date of Patent: Oct. 24, 2006

(54) GLASS GRINDING BIT

(76) Inventor: Michael Hacikyan, 1576 Sweet Home Rd., Amherst, NY (US) 14228

( * ) Notice: Subject to any disclaimer, the term of this patent is extended or adjusted under 35 U.S.C. 154(b) by 0 days.

(21) Appl. No.: 11/223,905

(22) Filed: Sep. 10, 2005

(51) Int. Cl.
*B24B 1/00* (2006.01)

(52) U.S. Cl. ..... 451/541; 451/43; 451/44

(58) Field of Classification Search ..... 451/43, 451/44, 178, 358, 361, 411, 541
See application file for complete search history.

(56) References Cited

U.S. PATENT DOCUMENTS

| | | | | |
|---|---|---|---|---|
| 4,904,130 | A | 2/1990 | Gorman | 408/16 |
| 5,029,459 | A | 7/1991 | Almblad | 70/408 |
| 5,102,271 | A | 4/1992 | Hemmings | 408/226 |
| 5,643,069 | A * | 7/1997 | Christiansen et al. | 451/540 |
| 5,829,590 | A | 11/1998 | Klein | 206/369 |
| 5,859,603 | A * | 1/1999 | Noguchi et al. | 341/77 |
| 5,865,571 | A | 2/1999 | Tankala et al. | 408/1 |
| 6,227,188 | B1 | 5/2001 | Tankala et al. | 125/13.01 |
| 6,241,589 | B1 * | 6/2001 | Hacikyan | 451/59 |
| 6,416,394 | B1 * | 7/2002 | Hacikyan et al. | 451/44 |
| 6,629,877 | B1 * | 10/2003 | Cerniway | 451/43 |
| 7,044,843 | B1 * | 5/2006 | Lin | 451/178 |
| 2002/0004362 | A1 | 1/2002 | Lubke | 451/488 |
| 2002/0102515 | A1 | 8/2002 | Weathers, Jr. | 433/165 |
| 2003/0049586 | A1 | 3/2003 | Kumar | 433/165 |
| 2004/0043708 | A1 * | 3/2004 | Hacikyan | 451/41 |
| 2004/0099104 | A1 | 5/2004 | Pearson | 81/176.15 |
| 2004/0210231 | A1 | 10/2004 | Boucher et al. | 606/93 |
| 2004/0265082 | A1 | 12/2004 | Abrams | 408/226 |

* cited by examiner

*Primary Examiner*—Lee D. Wilson
*Assistant Examiner*—Anthony Ojini
(74) *Attorney, Agent, or Firm*—Walter W. Duft

(57) ABSTRACT

A glass grinding bit includes a monolithic plastic body having a first end, a second end and a central longitudinal axis. A central bore formed as part of the body in alignment with the longitudinal axis for receiving a drive shaft. An outer surface is formed as part of the body in alignment with the longitudinal axis and in concentric relationship with the central bore. A grinding sleeve has an inner surface in permanent interfacial contact with the body outer surface and an abrasive outer grinding surface. A threaded bore in the body extends transversely from the body outer surface to the central bore. A set screw in the transverse bore allows the grinding bit to be secured to a drive shaft. According to construction alternatives, the grinding bit may variously include (1) compressive members on the body outer surface that engage the grinding sleeve inner surface, (2) an apertured bore-defining structure within the body, and (3) the body being formed of a transparent or translucent plastic whose color signifies a surface roughness of the grinding sleeve.

20 Claims, 3 Drawing Sheets

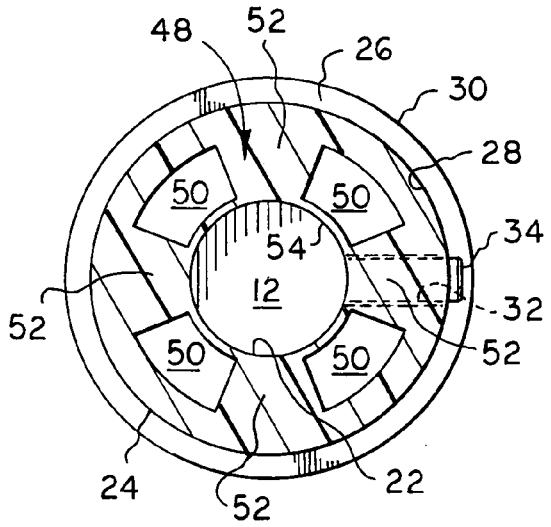
FIG. 3
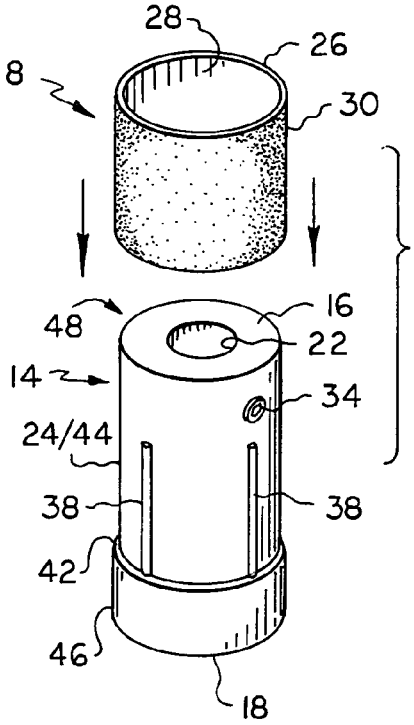
FIG. 5
FIG. 6
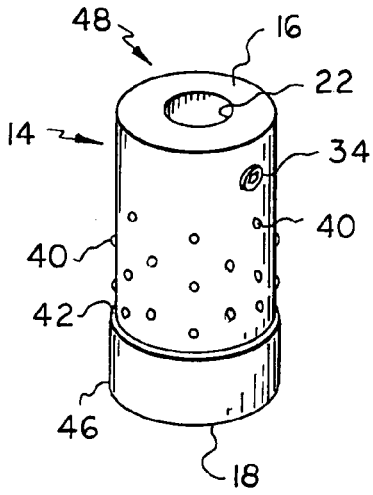

GLASS GRINDING BIT

BACKGROUND OF THE INVENTION

1. Field of the Invention

The present invention relates generally to grinding apparatus. More particularly, the invention concerns glass grinding apparatus, and especially table top grinders for use by hobbyists in the fabrication of glass artwork and decorative glass products.

2. Description of Prior Art

By way of background, there is a wide variety of grinding apparatus for shaping and/or surfacing many different kinds of materials. Of particular interest herein are table-top grinders of the type used by glass hobbyists and the like. Commonly assigned U.S. Pat. No. 6,416,394, entitled "Planer/Grinder For Glass," whose contents are incorporated herein by this reference, exemplifies such equipment. The typical glass grinding apparatus includes a cylindrical grinding bit mounted on a motor-driven shaft that spins above a horizontal work piece platform. The grinding bit typically comprises a cylindrical body made of brass, aluminum or other metal that is secured to the drive shaft by way of a set screw made of steel or the like. A tubular sleeve made of nickel or other metal is mounted on the cylindrical body. The sleeve is formed with a surface coating of diamonds or other abrasive particles capable of grinding, sanding or polishing glass. A glass work piece that is to be shaped or otherwise treated is placed on the platform and advanced until its edge contacts the grinding bit. By maneuvering the work piece relative to the grinding bit, material can be selectively removed from the work piece edge to create a desired shape and/or surface treatment.

There are several problems associated with the conventional glass grinding bit described above. First, the metal body is relatively hard and when rotated at high speed may impart vibrational shock loads that can chip the glass. Second, an aqueous irrigation fluid is used to lubricate the grinding bit and cool the glass during grinding. This fluid, together with galvanic action, tends to produce corrosion between the brass set screw and the brass body such that the grinding bit may be difficult to remove after prolonged use. Third, grinding bits are offered in different grades according to the desired amount of abrasiveness (e.g., ultra-fine, fine, medium, coarse, ultra-course, etc.). Such grinding bits are sometimes difficult to differentiate because they all use the same metal body and sleeve material; only the abrasive surface is different and this difference may be difficult to detect by sight or touch.

It is to improvements in the design of glass grinding bits that the present invention is directed. In particular, what is needed is a grinding bit that overcomes one or more (and preferably all) of the above-mentioned deficiencies found in existing grinding bits.

SUMMARY OF THE INVENTION

The foregoing problems are solved and an advance in the art is provided by a novel glass grinding bit. The grinding bit includes a monolithic plastic body having a first end, a second end and a central longitudinal axis. A central bore is formed as part of the body in alignment with the longitudinal axis for receiving a drive shaft. An outer surface is formed as part of the body in alignment with the longitudinal axis and in concentric relationship with the central bore. A grinding sleeve has an inner surface in permanent interfacial contact with the body outer surface, and an abrasive outer grinding surface. A threaded bore in the body extends transversely from the body outer surface to the central bore. A set screw in the transverse bore allows the grinding bit to be secured to a drive shaft.

According to one exemplary construction of the grinding bit, the body outer surface can be shaped to define one or more compressive members that compressibly engage the grinding sleeve inner surface. According to another exemplary construction of the grinding bit, an apertured bore-defining structure, such as a structure having plural pie-shaped slots separating plural pie-shaped flanges, may be situated between the body outer surface and the bore. A blind cavity may also extend from one end of the body to the bore. According to still another exemplary construction of the grinding bit, the body can be formed of a transparent or translucent plastic whose color signifies a surface roughness of the grinding sleeve. In a collection of such grinding bits, different body colors may be used to allow users to visually identify grinding bits of different roughness without inspecting the grinding sleeve.

BRIEF DESCRIPTION OF THE DRAWINGS

The foregoing and other features and advantages of the invention will be apparent from the following more particular description of preferred embodiments of the invention, as illustrated in the accompanying Drawings in which:

FIG. 3 is a cross-sectional view taken along line 3—3 in FIG. 2;

FIG. 5 is an exploded perspective view of the grinding bit of FIG. 1 showing a grinding sleeve being placed on a grinding bit body;

FIG. 6 is a perspective view of an alternative body construction that may be used in the grinding bit of FIG. 1.

DETAILED DESCRIPTION OF PREFERRED EMBODIMENTS

Figure 1:
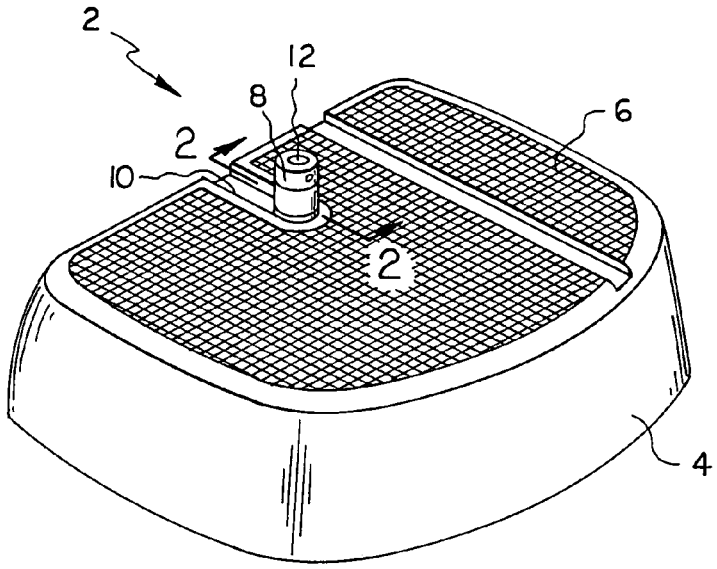
FIG. 1 is perspective view of a glass grinding apparatus mounting a glass grinding bit constructed in accordance with the present invention.

Turning now to the Drawings, wherein like reference numerals signify like elements in all of the several views, FIG. 1 illustrates an exemplary grinding apparatus 2 for grinding glass. The grinding apparatus 2 is shown to include a generally rectangular base 4, upon which is seated a horizontal work table configured as a work piece support grid 6. The support grid 6 is formed as a lattice structure that provides a support surface for a work piece (not shown) during grinding operations while freely passing irrigation fluid through plural apertures formed in the grid. A grinding bit 8 extends above a slot opening 10 in the support grid 6 for grinding a work piece. As described in more detail below, the grinding bit 8 is secured to a rotating drive shaft 12 that is driven at high speed by an electric drive motor (not shown) situated within the base 4.

Although not shown, a shallow fluid tray is disposed below the support grid 6 and provides a reservoir for holding a quantity of irrigation fluid for cooling and cleaning the grinding bit 8. The irrigation fluid will typically be water, but other liquids could also be used, such as alcohols, ketones, acidic liquids, and basic liquids. A fluid applicator (also not shown) is used to direct the irrigation fluid to the grinding bit 8.

Figure 2:
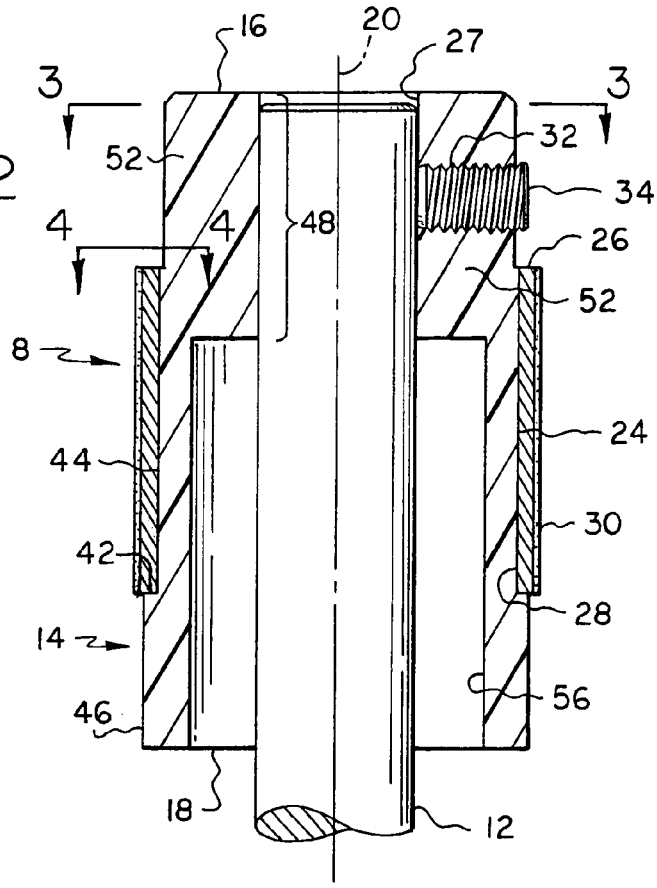
FIG. 2 is a cross-sectional view taken along line 2—2 in FIG. 1.

Turning now to FIG. 2, the grinding bit 8 includes a monolithic body 14 that is generally cylindrical or tubular, and has having a first end 16, a second end 18 and a central longitudinal axis 20. The body 14 comprises a high-strength, durable plastic material, such as polycarbonate, UHMW (Ultra-High Molecular Weight) polyethylene, or the like, that can be formed by injection molding or other suitable processes. Delrin® acetyl (Poly-Oxy-Methylene) resin (produced by Dupont Corporation) is another exemplary plastic that may be used. A central bore 22 is formed as part of the body 14 in alignment with the longitudinal axis for receiving the drive shaft 12. An outer surface 24 is formed as part of the body 14 in alignment with the longitudinal axis and in concentric relationship with the central bore 22. A grinding sleeve 26 has an inner surface 28 in permanent interfacial contact with the body outer surface 24 and an abrasive outer grinding surface 30. The grinding sleeve 26 can be formed in conventional fashion as a tube made of nickel or other metal with a surface coating of diamonds or other abrasive particles capable of grinding, sanding or polishing glass. A threaded bore 32 in the body 14 extends transversely from the body outer surface 24 to the central bore 22. A set screw 34 in the transverse bore 32 allows the grinding bit 8 to be secured to the drive shaft 12. The set screw 34 can be conventionally made of nickel or other metal.

Figure 4:
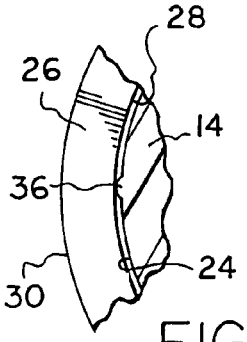
FIG. 4 is an enlarged cross-sectional view taken along line 4—4 in FIG. 2.

According to one exemplary construction of the grinding bit 8, the body outer surface 24 can be shaped to define one or more compressive members 36 (see FIG. 4) that compressibly engage the grinding sleeve inner surface 28. The compressive members 36 assist in mounting the grinding sleeve 26 and also provide shock absorbing properties (via compressive member deformation) to help minimize glass workpiece chipping. The compressive members 36 may be formed as protrusion elements, such as the longitudinally extending ridges 38 of FIG. 5, or the raised dimples 40 of FIG. 6. A circumferential ridge 42 can be integrally formed on the body outer surface 24 in order to provide a stop surface for engaging one end of the grinding sleeve 26. The ridge 42 separates a first body outer surface portion 44 having a first diameter from a second body outer surface portion 46 having a second diameter that is larger than the first diameter.

As additionally shown in FIG. 3, the grinding bit 14 can be formed with an apertured bore-defining structure 48. The bore-defining structure 48 is radially disposed between the central bore 22 and the body outer surface 24, and extends from a location proximate to the first end 16 of the body 14 toward the body's second end 18. The bore-defining structure 48 may include plural cavities, such as pie-shaped slots 50, separating plural spoke members, such as pie-shaped flanges 52. A continuous ring 54 may be formed to interconnect the flanges 52 and further define the central bore 22. The apertured bore-defining structure 48 allows less material to be used in the formation of the body 14. It also controls injection molding shrinkage and provides shock absorbing properties (via flange deformation) to help minimize glass workpiece chipping. If desired, the bore-defining structure 48 could extend all the way to the first end 16 of the body 14, such that the slots 50 and the flanges 52 are accessible from that end. More preferably, however, the bore-defining structure 48 will be slightly recessed from the first end 16 of the body 14. The first end 16 the body 14 will then have a solid face (except for the central bore 22) that prevents fluid and sludge material from entering the top of the bore-defining structure 48. Further material savings can be achieved by forming additional apertures in the body 14, such as a blind cavity 56 (see FIG. 2) that extends from the second end 18 of the body to the bore 22.

Figure 7:
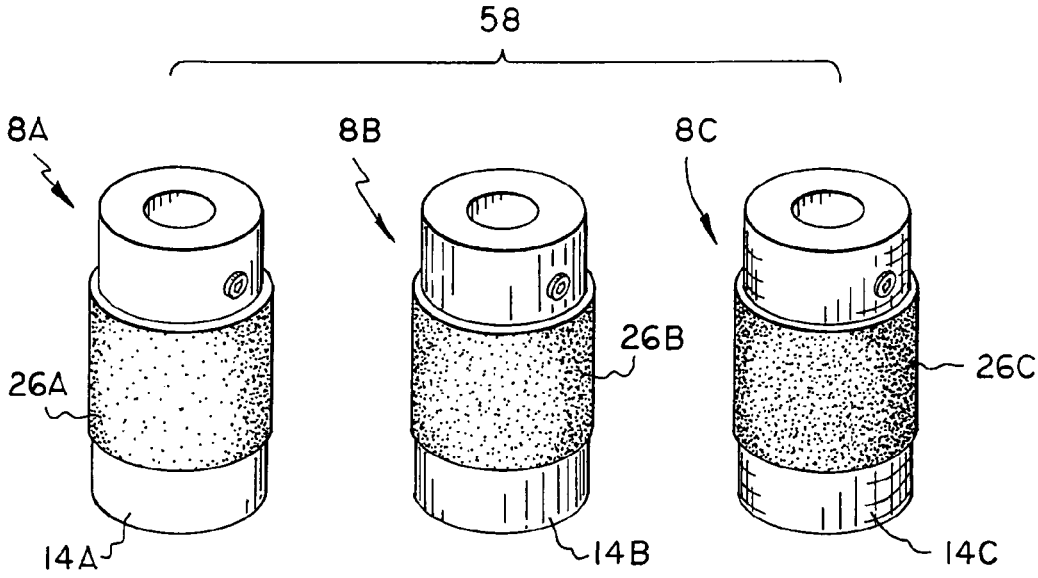
FIG. 7 is a perspective view showing a collection of grinding bits each having a characteristic color that identifies a characteristic grinding sleeve roughness.

Turning now to FIG. 7, a collection 58 of grinding bits 8A, 8B and 8C are shown in which the respective grinding sleeves 26A, 26B, and 26C of each grinding bit have a characteristic surface roughness that is different from the grinding sleeves of the other grinding bits. The bodies 14A, 14B and 14C of each grinding bit 8A, 8B and 8C can be formed of a transparent or translucent plastic having a unique color that signifies a surface roughness of the associated grinding sleeve. By way of example only, the grinding bit 8A could have a body 14A that is colored green to signify that its grinding sleeve 26A has a fine texture. By way of further example, the grinding bit 8B could have a body 14B that is colored amber to signify that its grinding sleeve 26B has a medium texture. By way of further example, the grinding bit 8C could have a body 14C that is colored red to signify that its grinding sleeve 26C has a course texture. Many other color combinations (and texture gradations) could also be used. In the collection 58, the various body colors allow users to visually identify grinding bits of different roughness without having to closely inspect the grinding sleeves.

Accordingly, an improved glass grinding bit has been disclosed. While various embodiments of the invention have been disclosed, it should be apparent that many variations and alternative embodiments could be implemented in accordance with the teachings set forth herein. It will therefore be understood that the invention is not to be in any way limited except in accordance with the spirit of the appended claims and their equivalents.

What is claimed is:

1. A glass grinding bit, comprising:

a generally cylindrical, monolithic plastic body having a first end, a second end and a central longitudinal axis;

a central bore formed as part of said body in alignment with said longitudinal axis for receiving a drive shaft;

an outer surface formed as part of said body in alignment with said longitudinal axis and in concentric relationship with said central bore;

said body outer surface being shaped to define one or more compressive members;

a grinding sleeve on said body outer surface;

said grinding sleeve having an inner surface in permanent interfacial contact with said compressive members and an abrasive outer grinding surface;

a threaded bore in said body extending transversely from said body outer surface to said central bore; and a set screw in said transverse bore for securing said grinding bit to a drive shaft.

2. A glass grinding bit in accordance with claim 1, wherein said compressive members comprise a plurality of protrusion elements.

3. A glass grinding bit in accordance with claim 2, wherein said protrusion elements comprise longitudinally extending ridges.

4. A glass grinding bit in accordance with claim 2, wherein said protrusion elements comprise raised dimples.

5. A glass grinding bit in accordance with claim 1, further including a circumferential ridge on said body outer surface separating a first body outer surface portion having a first diameter and a second body outer surface portion having a second diameter, said grinding sleeve being mounted on said first body outer surface portion.

6. A glass grinding bit in accordance with claim 5, wherein said first body outer surface portion is smaller in diameter than said second body outer surface portion.

7. A glass grinding bit in accordance with claim 1, wherein said body further includes plural cavities disposed radially between said central bore and said body outer surface.

8. A glass grinding bit in accordance with claim 1, wherein said body is transparent or translucent.

9. A glass grinding bit in accordance with claim 8, wherein said body comprises a colored plastic whose color signifies a surface roughness of said outer grinding sleeve.

10. A glass grinding bit in accordance with claim 1, wherein said set screw is metal and said grinding sleeve is a metal sleeve having abrasive particles on said outer grinding surface.

11. A glass grinding bit, comprising:

a generally tubular, monolithic plastic body having a first end, a second end, a central longitudinal axis and a tubular wall;

an outer surface formed as part of said body in alignment with said longitudinal axis and defining an outer surface of said tubular wall;

an interior blind cavity formed as part of said body in alignment with said longitudinal axis and in concentric relationship with said tubular wall outer surface, said cavity defining an inner surface of said tubular wall that is spaced from said tubular wall outer surface;

an apertured bore-defining structure extending inwardly from said tubular wall and terminating at a central bore disposed in alignment with said longitudinal axis for receiving a drive shaft;

a grinding sleeve on said tubular wall outer surface;

said grinding sleeve having an inner surface in permanent interfacial contact with said tubular wall outer surface and an abrasive outer grinding surface;

a threaded bore in said body extending transversely from said tubular wall outer surface to said central bore; and a set screw in said transverse bore for securing said grinding bit to a drive shaft.

12. A glass grinding bit in accordance with claim 11, wherein said bore-defining structure comprises plural pie-shaped slots.

13. A glass grinding bit in accordance with claim 12, wherein said bore-defining structure comprises plural pie-shaped flanges disposed between said pie-shaped slots.

14. A glass grinding bit in accordance with claim 13, further including a continuous ring interconnecting said flanges and defining said bore.

15. A glass grinding bit in accordance with claim 11, further including a plurality of protrusion elements integrally formed on said body outer surface for compressibly engaging said grinding sleeve inner surface.

16. A glass grinding bit in accordance with claim 15, wherein said protrusion elements comprise longitudinally extending ridges.

17. A glass grinding bit in accordance with claim 15, wherein said protrusion elements comprise raised dimples.

18. A glass grinding bit in accordance with claim 11, further including a circumferential ridge on said tubular wall outer surface separating a first tubular wall outer surface portion having a first diameter and a second tubular wall outer surface portion having a second diameter, said grinding sleeve being mounted on said first tubular wall outer surface portion.

19. A glass grinding bit in accordance with claim 18, wherein said first tubular wall outer surface portion is smaller in diameter than said second body tubular wall surface portion.

20. A collection of glass grinding bits, each comprising:

a generally cylindrical, monolithic plastic body having a first end, a second end and a central longitudinal axis;

a central bore formed as part of said body in alignment with said longitudinal axis for receiving a drive shaft;

an outer surface formed as part of said body in alignment with said longitudinal axis and in concentric relationship with said central bore;

a grinding sleeve on said body outer surface;

said grinding sleeve having an inner surface in permanent interfacial contact with said body outer surface and an abrasive outer grinding surface having a characteristic surface roughness;

a threaded bore in said body extending transversely from said body outer surface to said central bore; and a set screw in said transverse bore for securing said grinding bit to a drive shaft;

and further wherein said body of each of said grinding bits of said collection is transparent or translucent, and comprises a colored plastic whose color is different from the color of other grinding bits of said collection and which signifies the characteristic surface roughness of the outer grinding sleeve associated with said grinding bit.

* * * * *